United States Patent [19]

Tamaki et al.

[11] Patent Number: 4,707,577

[45] Date of Patent: Nov. 17, 1987

[54] VACUUM INTERRUPTER

[75] Inventors: Nobuaki Tamaki, Numazu; Shinzo Sakuma, Kawasaki; Toshimasa Fukai; Masatoshi Takihana, both of Numazu, all of Japan

[73] Assignee: Kabushiki Kaisha Meidensha, Tokyo, Japan

[21] Appl. No.: 31,693

[22] Filed: Mar. 27, 1987

[30] Foreign Application Priority Data

| | | |
|---|---|---|
| Apr. 5, 1986 | Japan | 61-78866 |
| Apr. 22, 1986 | Japan | 61-93079 |
| Apr. 22, 1986 | Japan | 61-93080 |
| Apr. 27, 1986 | Japan | 61-151117 |

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,372,258 | 3/1968 | Porter | 200/144 B |
| 3,581,142 | 5/1971 | Boxman | 200/144 B |
| 4,039,792 | 8/1977 | Crouch et al. | 200/144 B |
| 4,431,885 | 2/1984 | Sakuma et al. | 200/144 B |
| 4,478,347 | 10/1984 | Cherry et al. | 200/144 B |
| 4,528,432 | 7/1985 | Senba et al. | 200/144 B |
| 4,661,666 | 4/1987 | Sukuma et al. | 200/144 B |

*Primary Examiner*—Robert S. Macon

*Attorney, Agent, or Firm*—Bachman & LaPointe

[57] ABSTRACT

An inventive vacuum interrupter has an improved dielectric strength and durability which leads to an improved interruption performance. The interrupter has a vacuum envelope comprising an insulating cylinder, a metal end plate hermetically sealed to one edge of the insulating cylinder, a bottomed metal cylinder with its open end hermetically sealed to the other edge of the insulating cylinder, and a metal bellows connected to the bottom of the metal cylinder. A stationary lead rod passes through the metal end plate and the insulating cylinder and terminates within the metal cylinder, an inner end of the stationary lead rod carrying a stationary electrode. A movable lead rod extends coaxially with the stationary lead rod, an inner end of the movable lead rod carrying a movable electrode. The movable lead rod is sufficiently longer than the stationary lead rod. The metal bellows is located outside of the metal cylinder and has an exterior exposed to the air and an interior exposed to the vacuum within the vacuum envelope. A coil producing an axial magnetic field in parallel to an arc current path formed between the electrodes when the electrodes are separated surrounds the electrodes outside of the metal cylinder.

7 Claims, 6 Drawing Figures

VACUUM INTERRUPTER

BACKGROUND OF THE INVENTION

1. Field of the Invention

This invention generally relates to a vacuum interrupter, and more particularly to an axial magnetic field applied type vacuum interrupter which applies an axial magnetic field in parallel to an arc current path produced between separated electrodes within the vacuum envelope of the interrupter.

2. Description of the Prior Art

U.S. Pat. No. 4,661,666 issued Apr. 28, 1987 discloses a prior-art vacuum interrupter as shown in FIG. 1. This interrupter has a vacuum envelope 1 and a disc-shaped stationary electrode 2 and a movable electrode 3 disposed within the vacuum envelope 1 and operable for forming or interrupting electrical contact therebetween. The vacuum envelope 1 comprises an insulating cylinder 4, a disc-shaped metal end plate 5 hermetically secured to one edge of the insulating cylinder 4 via a metal seal ring 6, a bottomed metal cylinder 7 the open end of which is hermetically secured to the other edge of the insulating cylinder 4 via a metal seal ring 6. The stationary and movable electrodes 2 and 3 are located within the metal cylinder 7.

A stationary lead rod 9 passes hermetically through and is fixed to a flat bottom 7*a* of the metal cylinder 7. An inner end of the stationary lead rod 9 carries the stationary electrode 2 within the metal cylinder 7. On the other hand, a movable lead rod 10 passes loosely through the metal end plate 5 and is hermetically secured to the metal end plate 5 via a metal bellows 11. An inner end of the movable lead rod 10 carries the movable electrode 3 within the metal cylinder 7. Thus, the movable lead rod 10 is considerably longer than the stationary lead rod 9. The bellows 11 is located within the insulating cylinder 4 with its inner surface exposed to the atmosphere. The bellows 11 is as remote from the electrodes 2 and 3 within the vacuum envelope 1 as possible in order to protect the bellows 11 from the deposition of the metal vapor generated by the electrodes 2 and 3 during opening and closing operations. A cup-shaped bellows shield 12 is fixed to an intermediate portion of the movable lead rod 10. The bellows shield 12 also protects an inner end area of the bellows 11 from deposition of the metal vapor.

A coil 13 of substantially one turn surrounds the stationary and movable electrodes 2 and 3 outside the cylindrical portion of the metal cylinder 7. The coil 13 produces an axial magnetic field running parallel to the arc current path between the separated stationary and movable electrodes 2 and 3 for dispersing the arc evenly across the opposing faces of the electrodes thereby increasing the current interruption performance of the interrupter. One end 13*a* of the coil 13 is electrically connected to an outer end of the stationary lead rod 9. The other end 13*b* of the coil 13 is electrically connected to one end of an outer lead rod 14 which is located outside the vacuum envelope 1. The outer lead rod 14 extends perpendicularly to the stationary lead rod 9.

An outer lead rod 15 which is located outside the vacuum envelope 1 extends parallel to the outer lead rod 14. One end of the outer lead rod 15 has a slide contact 16 which mechanically and electrically engages an outer end of the movable lead rod 10. A main shield 17 is fixed to an inner cylindrical surface of the metal cylinder 7. The electrical potential of the main shield 17 is equal to that of the stationary lead rod 9 but different from that of the movable lead rod 10. An auxiliary shield 18 is fixed to the end plate 5.

In the operation of the above-described interrupter, a current (e.g., a fault current) passes through a sequence comprising the outer lead rod 14, the coil 13, the stationary lead rod 9, the stationary electrode 2, the arc current path between the stationary electrode 2 and the movable electrode 3, the movable electrode 3, the movable lead rod 10, the slide contact 15 and the outer lead rod 15 and vice versa. Therefore, the stationary and movable lead rods 9 and 10 are subjected to a resulting electro-magnetic force with a radial vector in accordance with the left-hand rule when a current passes through the above-described sequence. The electromagnetic force radially inclines the movable lead rod 10 when the stationary and movable electrodes 2 and 3 are out of contact. This inclination displacement reduces the clearance between the movable lead rod 10 and the main shield 17 which have different potentials, which in turn reduces the dielectric strength of the vacuum interrupter. An inclination displacement of the movable lead rod 10 due to the electro-magnetic force of the coil 13 causes the stationary and movable electrodes 2 and 3 to be in point-to-point contact at outer peripheries of the stationary and movable electrodes 2 and 3. Thus, a mechanical impact force occurring during closing operation of the stationary and movable electrodes 2 and 3 concentrates at the point of contact between the stationary and movable electrodes 2 and 3. This concentration of the mechanical impact force can possibly split or break the stationary and movable electrodes 2 and 3 during many opening and closing operations. Thus the radial displacement of the movable electrode 2 causes premature wear and reduced dielectric strength in the vacuum interrupter. Furthermore, the lengthiness of the movable lead rod 10 increases the total weight of the movable assembly associated with the movable lead rod 10, and the load of weight on the associated operating mechanism for the movable lead rod 10.

Most of the metal vapor produced during the opening operation of the stationary and movable electrodes 2 and 3 disperses to a space behind the movable electrode 3 in the insulating cylinder 4 rather than the space behind the stationary electrode 2 because the space behind the movable electrode 3 is greater than the space behind the stationary electrode 2. Therefore, some of the dispersing metal vapor deposits on the surface of the bellows 11 during many (no less than 10,000 times) opening and closing operations in spite of the presence of the bellows shield 12. The metal vapor deposited on the bellows 11 melts a little bit of the surface of the bellows 11 and causes the adjacent annular portions of the bellows 11 to stick each other because the bellows 11 contracts during the opening operation of the stationary and movable electrodes 2 and 3 when the vapor is formed. The sticking together of the adjacent annular portions of the bellows causes them to tear and leak thus compromizing the vacuum within the vacuum envelope 1.

In the prior-art vacuum interrupter, the short stationary lead rod 9 connects the stationary and movable electrodes 2 and 3 to the coil 13, so that Joule heat due to contact resistance between the stationary and movable electrodes 2 and 3 cannot be dissipated sufficiently through the stationary lead rod 9. Moreover, Joule heat produced by the coil 13 is added to that produced by contact resistance. Thus, the temperature of the vacuum interrupter may be caused to exceed the maximum temperature (e.g., a temperature of a silver-plating-free lead rod being 90° C. under an ambient temperature of 40° C.) permissible for the vacuum interrupter.

In addition, the vacuum interrupter usually constitutes part of a circuit breaker installed in a metal-clad switchgear, the stationary lead rod 9 being located in an upper portion of the vacuum interrupter. Thus, the coil 13 as a heat transmitter surrounds the upper portion of the vacuum interrupter. This arrangement blocks the natural convection along the outer length of the vacuum envelope within the surrounding atmosphere, thus blocking heat dissipation from the vacuum interrupter.

SUMMARY OF THE INVENTION

An object of this invention is to provide a vacuum interrupter with an improved dielectric strength.

Another object of this invention is to provide a vacuum interrupter in which point-to-point contact between the electrodes does not occur.

A further object of this invention is to provide a vacuum interrupter with improved heat dissipation capability.

In order to achieve these and other objects, an inventive vacuum interrupter comprises a vacuum envelope including an insulating cylinder, a metal end plate hermetically sealed to one end of the insulating cylinder and a bottomed metal cylinder having an open end hermetically sealed to the other end of the insulating cylinder; a pair of disc-shaped electrodes disposed within the metal cylinder one of which being stationary and the other of which being movable for establishing or interrupting contact between opposing contact faces of the disc-shaped electrodes; a stationary lead rod passing through and hermetically sealed to the metal cylinder, the stationary lead rod having an inner end fixed to the stationary electrode; a movable lead rod passing through the bottom of the metal cylinder and being movable coaxially with the stationary lead rod,. the movable lead rod having an inner end fixed to the movable electrode and an outer end located outside the vacuum envelope, the movable lead rod being shorter than the stationary lead rod; a metal bellows surrounding part of the movable lead rod and hermetically and electrically connecting the movable lead rod to the flat bottom of the metal cylinder, the metal bellows being located outside of the metal cylinder and having an exterior exposed to the air and an interior exposed to the vacuum inside of the vacuum envelope; and a coil located outside the metal cylinder and surrouding the stationary and movable electrodes, the coil having one end electrically connected to the outer end of the movable lead rod via a slide contact engaging the outer end of the movable lead rod and having the other and electrically connected to an outer lead means, the coil producing an axial magnetic field in parallel to an arc current path formed between the stationary and movable electrodes when the movable electrode is separated from the stationary electrode.

DESCRIPTION OF THE PREFERRED EMBODIMENTS

The preferred embodiments of this invention will be described with reference to FIGS. 2 to 6.

Figure 2:
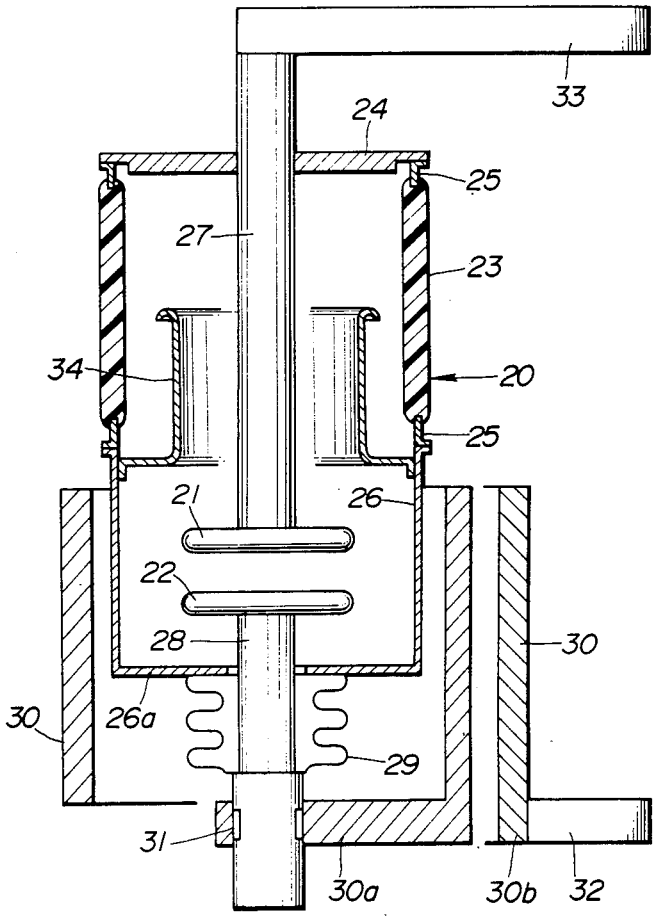
FIG. 2 is a longitudinal section through a vacuum interrupter according to a first embodiment of this invention.

FIG. 2 illustrates a vacuum interrupter according to a first embodiment of this invention. This vacuum interrupter has a vacuum envelope 20 with a stationary disc-shaped electrode 21 and a movable disc-shaped electrode 22 disposed within it. The vacuum envelope 1 comprises an insulating cylinder 23 made of glass or insulating ceramics, a disc-shaped metal end plate 24 hermetically secured to one end **23*a* of the insulating cylinder 23 via an annular metal seal ring 25 made of Koval (i.e. a Fe-Ni-Co alloy), and a metal cylinder 26 made of non-magnetic stainless steel, e.g., an austenitic stainless steel, the open end of the metal cylinder 26 being hermetically secured to the other edge 23*b* of the insulating cylinder 23 via an annular metal seal ring 25. The interior of the vacuum envelope 20 is evacuated to a pressure equal to or below 6.67 mPa. The stationary and movable electrodes 21 and 22 are located within the metal cylinder 26. The stationary electrode 21 and the movable electrode 22 can be moved into or out of contact with each other within the metal cylinder 26**.

A stationary lead rod 27 which is located within the vacuum envelope 20 passes hermetically through and is fixed to the metal end plate 24. An inner end of the stationary lead rod 27 carries the stationary electrode 21 within the metal cylinder 26. On the other hand, a movable lead rod 28 passes loosely through the flat bottom **26*a* of the metal cylinder 26. The movable lead rod 28 is hermetically secured to the bottom 26*a* of the metal cylinder 26 via a metal bellows 29. The inner end of the movable lead rod 28 carries the movable electrode 22 within the metal cylinder 26. Thus, the stationary lead rod 27 is considerably longer than the movable lead rod 28. The bellows 29 is located adjacent to the outside of the flat bottom 26*a* of the metal cylinder 26 so that the inner surface of the bellows 29 is exposed to the vacuum inside the vacuum envelope 20**.

A cylindrical coil 30 of substantially one turn surrounds the stationary and movable electrodes 21 and 22 outside the cylindrical portion of the metal cylinder 26. The coil 30 produces an axial magnetic field parallel to an arc current path produced between the separated stationary and movable electrodes 21 and 22. One end **30*a* of the coil 30 has a slide contact 31 which mechanically and electrically engages an outer end of the movable lead rod 28. The other end 30*b* of the coil 30 is electrically connected to one end of an outer lead rod 32 which is located outside the vacuum envelope 20. The outer lead rod 32 extends perpendicularly to the movable lead rod 28. An outer lead rod 33 which is located outside the vacuum envelope 20 extends in parallel to the outer lead rod 32. One end of the outer lead rod 33** is electrically connected to an outer end of the stationary lead rod 27.

A main shield 34 made of non-magnetic stainless steel, e.g., an austenitic stainless steel is fixed to an inner cylindrical surface of the cylinder 26 behind the stationary electrode 21. The electrical potential of the main shield 34 is different from that of the stationary lead rod 27 and the stationary electrode 21. The electrical potential of the main shield 34 and the metal cylinder 26 is equal to that of the movable lead rod 28 and the movable electrode 22.

In the operation of the above-described vacuum interrupter according to a first embodiment of this invention, a current (e.g., a fault current) passes through a sequence of the outer lead rod 33, the stationary lead rod 27, the stationary electrode 21, the arc current path between the stationary electrode 21 and the movable electrode 22, the movable electrode 22, the movable lead rod 28, the slide contact 31, the coil 30 and the outer lead rod 32 and vice versa. Therefore, the stationary and movable lead rods 27 and 28 are subjected to a resulting electro-magnetic force with a radial vector in accordance with the left-hand rule when a current passes through the above-described sequence.

The stationary lead rod 27 is subjected to a large bending moment produced due to the electro-magnetic force produced by a circuit current passing through the interrupter because the length of the portion extending from the metal end plate 24 to the stationary electrode 21 is greater than that of a corresponding portion of a conventional stationary lead rod. However, spatial relationships between the stationary lead rod 27 (and therefore the stationary electrode 21) and other surrounding members (e.g., the main shield 34) of the vacuum interrupter cannot be changed within the vacuum envelope 20 because the stationary lead rod 27 is firmly secured to the metal end plate 24. Thus, the spatial relationship between the stationary lead rod 27 and the main shield 34 which have different potentials from each other, is stable, so that the dielectric strength of gaps between the stationary lead rod 27 (and therefore the stationary electrode 21) and other surrounding members of the vacuum interrupter remain unchanged.

On the other hand, the movable lead rod 28 is subjected to a very small bending moment produced due to the electro-magnetic force produced by the circuit current because the length of the portion extending from the slide contact 31 to the movable electrode 22 is smaller than that of a corresponding portion of a conventional movable lead rod. Therefore, the tendency of electro-magnetic force produced by the circuit current to incline the movable lead rod 28 is greatly reduced, thereby greatly reducing the chance of a point-to-point contact occurring at the outer peripheries of the electrodes 21 and 22. Furthermore, while the electro-magnetic force produced by the circuit current may cause a slight inclination displacement of the movable lead rod 28, this inclination displacement cannot deteriorate the dielectric strength of the vacuum interrupter because of equipotentialities between the movable lead rod 28 (also therefore the movable electrode 22) and the surrounding members of the vacuum interrupter (e.g., the metal cylinder 26).

In addition, the shortness of the movable lead rod 28 greatly reduces the total weight of the movable assembly associated with the movable lead rod 28 and the weight load on the associated operating mechanism for the movable lead rod 28.

Most of the metal vapor produced by the opening operation of the stationary and movable electrodes 21 and 22 disperses to a space behind the stationary electrode 21 on the side of the insulating cylinder 23 rather than in the space behind the movable electrode 22. Therefore very little of dispersing metal vapor can deposit on the inner surface of the bellows 29 and although some of the dispersing metal vapor deposit on the inner surface of the bellows 29, adjacent annular portions of the bellows 29 cannot stick each other because the bellows 29 expands in the opening operation of the electrodes 21 and 22. Therefore, a damage to the bellows 29 due to sticking together of the adjacent annular portions of a large diameter of the bellows 29 does not occur.

Figure 3:
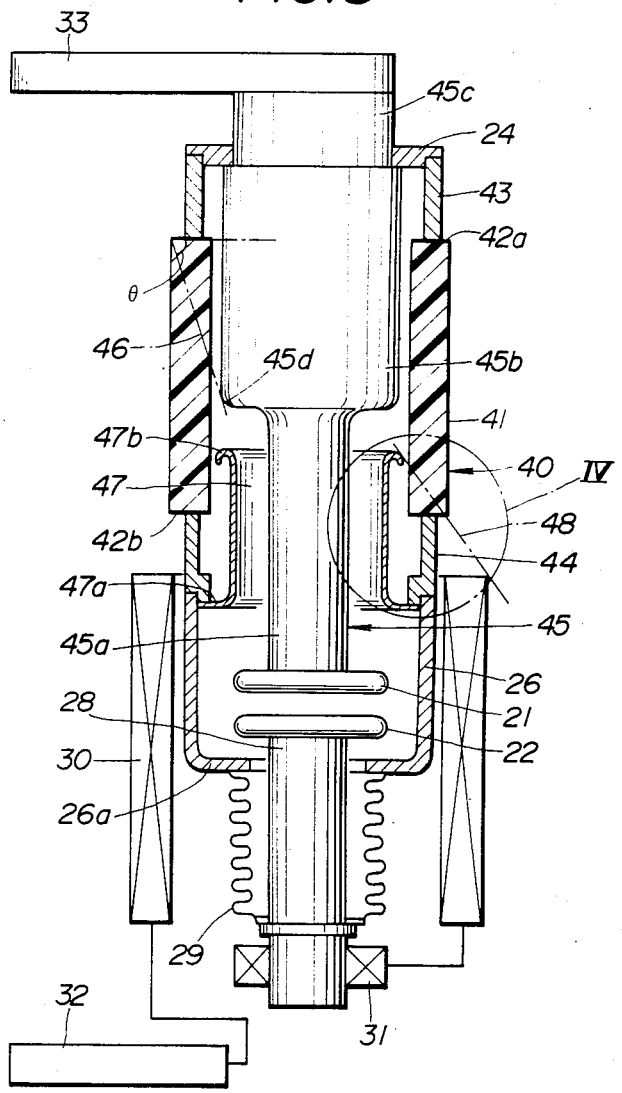
FIG. 3 is a longitudinal section through a vacuum interrupter according to a second embodiment of this invention.

FIG. 3 illustrates a vacuum interrupter according to a second embodiment of this invention. The same reference numerals will be applied to the parts shared in common with the first embodiment of this invention and the descriptions of those parts will not be repeated. The parts of the vacuum interrupter according to the second embodiment of this invention will be described in detail when they are different from the parts of the first embodiment of this invention. This vacuum interrupter has a vacuum envelope 40 and a pair of disc-shaped electrodes 21 and 22. The vacuum envelope 40 comprises an insulating cylinder 41 made of glass or insulating ceramics, the edges forming the opposite ends 41*a* and 41*b* of the insulating cylinder 41 having metallized layers 42*a* and 42*b*, a metal end plate 24 hermetically brazed to one metallized layer 42*a* of the insulating cylinder 41 via an annular seal ring 43 made of copper or Koval, and a metal cylinder 26 the open end of which being hermetically brazed to the other metallized layer 42*b* of the insulating cylinder 41 via an annular metal seal ring 44 made of copper or Koval. The interior of the vacuum envelope 40 is evacuated to a pressure equal to or below 6.67 mPa.

A stationary lead rod 45*a* which is aligned coaxially with the vacuum envelope 40 passes through and is hermetically fixed to the metal end plate 24. The inner end of the stationary lead rod 45 carries the stationary electrode 21 within the metal cylinder 26. The stationary lead rod 45 comprises a small diameter stem portion 45*a* near its inner end, a large diameter stem portion 45*b* adjacent to the small diameter stem portion 45*a* and an intermediate diameter stem portion 45*c* adjacent to the large diameter stem portion 45*b*. Assuming that a phantom line 46 commonly intersects the outer periphery of a shoulder 45*d* formed between the small diameter stem portion 45*a* and the large diameter stem portion 45*b* and past an outer periphery of the above-described one metallized layer 42*a* equipotential to the stationary lead rod 45 and the curled surface 47*b* of the main shield 47, the line 46 forms an angle equal to or above 60° with the one metallized layer 42*a*, thus forming a boundary preventing the concentration of electric field at the metallized layer 42*a*. The forward end of the small diameter stem portion 45*a* has the stationary electrode 21. The rear end of the small diameter stem portion 45*a* terminates in an intermediate area within the insulating cylinder 41. The intermediate diameter stem portion 45 *c* passes through the metal end plate 24. A shoulder formed between the intermediate diameter stem portion 45*c* and the large diameter stem portion 45*b* contacts the inner surface of the metal end plate 24. The intermediate diameter stem portion 45*c* is electrically connected to one end of an outer lead rod 33.

The presence of the large diameter stem portion 45b prevents the concentration of electric field at the metallized layer 42a and improves the mechanical strength and the thermal dissipation property of the stationary lead rod 45. The presence of the large diameter stem portion 45b also improves the mechanical strengths of the connections between the stationary lead rod 45 and the metal end plate 24 and between the stationary lead rod 45 and the outer lead rod 33.

A cylindrical main shield 47 made of non-magnetic stainless steel, e.g., an austenitic stainless steel is located opposite the inner surfaces of the metal seal ring 44 and the end 41b of the insulating cylinder 41. One end of the main shield 47 has an outwardly extending flange 47a which is fixed to a lower edge of the metal seal ring 44. The other end of the main shield 47 has an outwardly curled edge 47b. Assuming that a phantom tangential line 48 commonly passes past an outer periphery of one edge (an upper edge in FIG. 3) of the coil 30 and past an outer surface of the curled edge 47b of the main shield 47, the metallized layer 42b is located on the side of the phantom line 48 as the coil 30 and the main shield 47.

Figure 4:
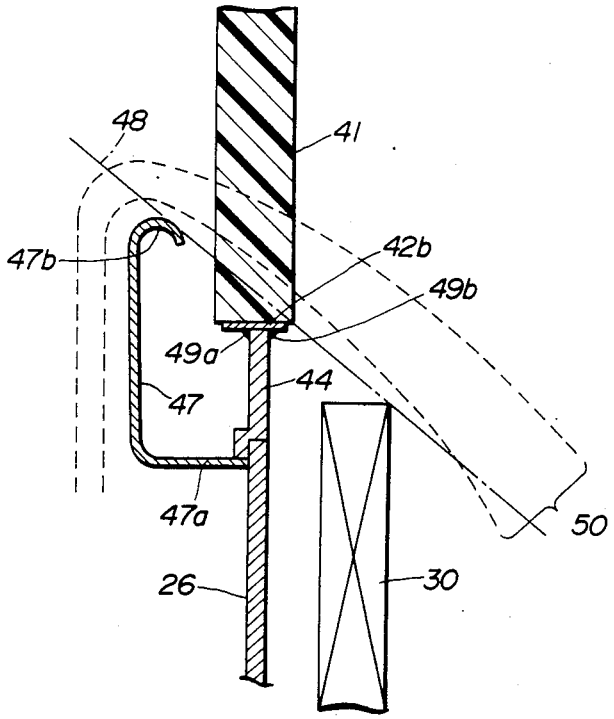
FIG. 4 is an enscaled view of an encircled part IV of FIG. 3.

FIG. 4 illustrates the detail of the encircled portion IV of FIG. 3. The metal seal ring 44 is in abutment with the metallized layer 42b on the edge 41b of the insulating cylinder 41. The metal seal ring 44 is brazed to the metallized layer 42b by means of interior and exterior brazing materials 49a and 49b. The metallized layer 42b and the interior and exterior brazing materials 49a and 49b are on the side of the main shield 47 and the coil 30 relative to the phantom line 48. As shown in FIG. 3, the potential of the main shield 47 is equal to that of the coil 30 when the stationary and movable electrodes 21 and 22 are electrically separated. Therefore, equipotential lines 50 are so delineated near the main shield 47 and the coil 30 as shown in FIG. 4, so that a concentration of electric field does not occur at the metallized layer 42b. The arrangement between the main shield 47, the existing coil 30 and the other metallized layer 42b degrades the concentration of electric field at the metallized layer 42b and the presence of the large diameter stem portion 45b of the stationary lead rod 45 prevents the concentration of electric field at the metallized layer 42a, thus improving the dielectric strength of the outer surface of the vacuum envelope 40.

In the second embodiment of this invention, the metal seal ring 43 is secured in a knife edge seal to the insulating cylinder 41. However, the connection between the metal seal ring 43 and the insulating cylinder 41 is not limited to such knife edge seal. Alternatively, one end of the metal seal ring 43 may be embedded in one edge 41a of the insulating cylinder 41. In this case, a phantom line commonly passing past the outer periphery of the shoulder 45 *d* of the stationary lead rod 45, past the curled edge 47b of the main shield 47 and past the embedded edge of the metal seal ring 43 should subtend an angle equal to or above e.g., 60° with the plane including the embedded annular edge of the metal seal ring 43 so that the electric field does not become concentrated at the embedded edge of the metal seal ring 43.

Figure 5:
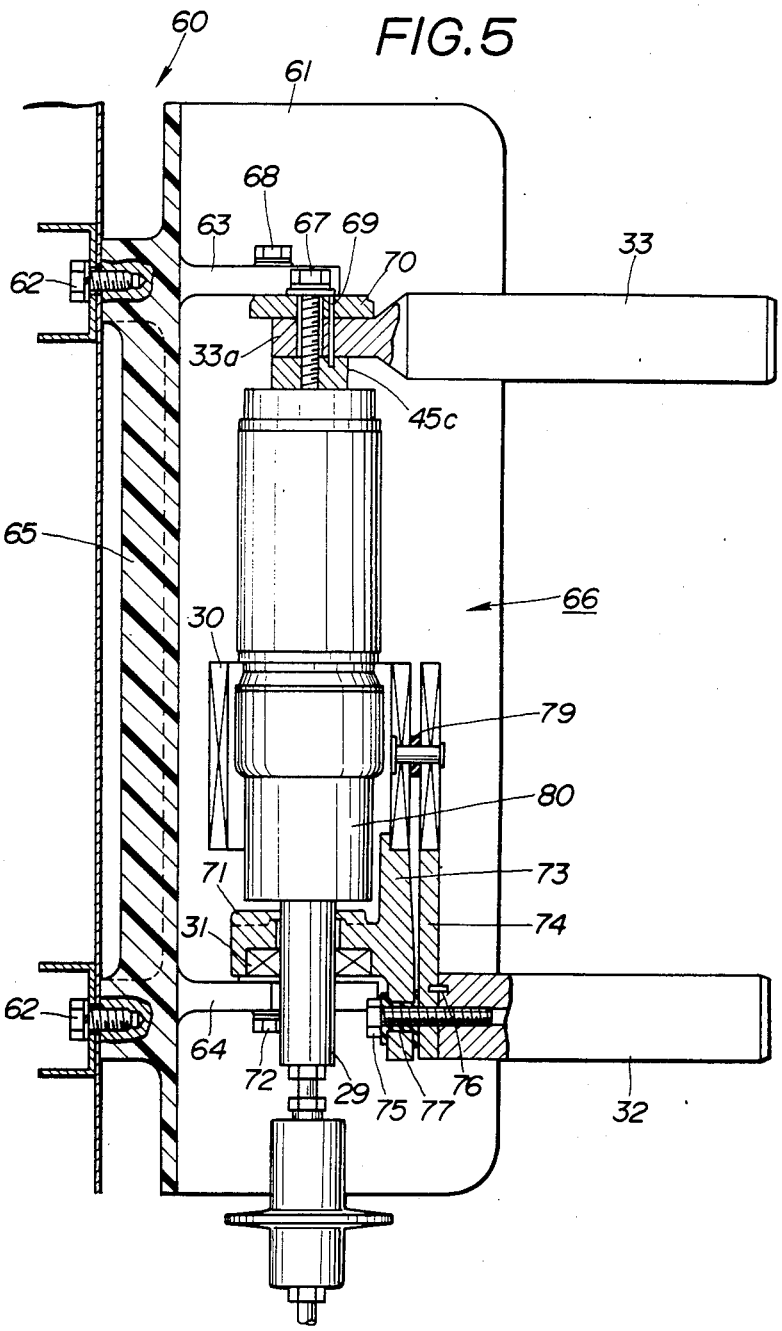
FIG. 5 illustrates an installation of a vacuum interrupter according to a third embodiment of this invention in a drawn-out type circuit breaker.

FIG. 5 illustrates an installation of a vacuum interrupter according to a third embodiment of this invention in a drawn-out type circuit breaker. The same reference numerals will be applied to the parts shared in common with first and second embodiments of this invention and the descriptions of the those parts will not be repeated. The parts of the vacuum interrupter according to the third embodiment of this invention will be described in detail when they are different from the parts of the first and second embodiments of this invention.

As shown in FIG. 5, a drawn-out type circuit breaker 60 which can move into and out of a metal-clad switchgear (not shown) has an insulating frame 61 with a U-shaped cross-section. The insulating frame 61 has no top or bottom and extends vertically and is fixed to a main frame of the circuit breaker by means of upper and lower bolts 62. The insulating frame 61 has upper and lower mounting brackets 63 and 64 projecting rearwardly from a front wall 65 of the insulating frame 61.

A vacuum interrupter 66 according to a third embodiment of this invention is installed between the upper and lower mount brackets 63 and 64 in the insulating frame 61. The intermediate diameter portion 45c of the stationary lead rod 45 and a flat end 33a of the outer lead rod 33 are secured to the upper mount bracket 63 by bolts 67 and 68 and a pin 69 via a washer 70. The bolt 67 extends coaxially with the stationary lead rod 45 and passes through the washer 70 and the flat end 33a of the outer lead rod 33 and terminates in the intermediate diamter portion 45c of the stationary lead rod 45. The pin 69 is installed eccentrically of the stationary lead rod 45 and passes through the washer 70 and the flat end 33a of the outer lead rod 33. The pin 69 terminates in the intermediate diameter portion 45c of the stationary lead rod 45. The combination of the bolt 67 and the pin 69 positively fixes the positional relationship between the washer 70, the outer lead rod 33 and the stationary lead rod 45. The bolt 68 secures the washer 70 to the upper mount bracket 63.

On the other hand, a metal arm 71 having an annular slide contact 31 is secured by a bolt 72 to the lower bracket 64. The movable lead rod 29 passes through the arm 71, the slide contact 31 and the lower mount bracket 64. The arm 71 extends perpendicularly to the movable lead rod 29 and constitutes an integral part of an electrical connector 73 which is disposed between the slide contact 31 and the inner end of the coil 30. An outer end of the coil 30 is electrically connected to the outer lead rod 32 via an electrical connector 74. The electrical connector 74 and the outer lead rod 32 are fixed by a combination of a bolt 75 and an eccentrically located pin 76 to the electrical connector 73 which is in turn fixed to the lower mount bracket 64. The electrical connectors 73 and 74 are insulated from each other by an insulating bushing 77 inserted between the electrical connectors 73 and 74. The inner and outer ends of the coil 30 are fixed to each other by bolt 78 and insulated from each other by an insulating spacer 79.

Figure 6:
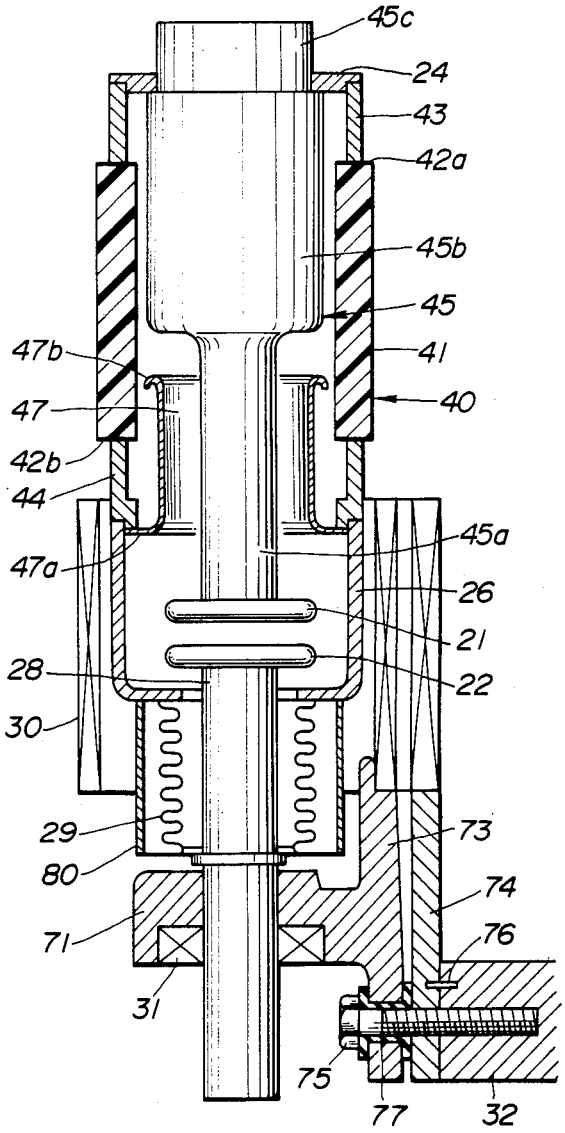
FIG. 6 is a longitudinal section through a vacuum interrupter according to a third embodiment of this invention.

FIG. 6 illustrates a longitudinal section through the vacuum interrupter according to the third embodiment of this invention which is similar to the second embodiment of this invention. The vacuum interrupter of the third embodiment has a bellows cover 80 surrounding the bellows 29.

Heated air ascends from the coil 30 as a heat transmitter within the insulating frame 61 via natural convection, so that heat dissipation for the vacuum interrupter can be effected.

Figure 1:
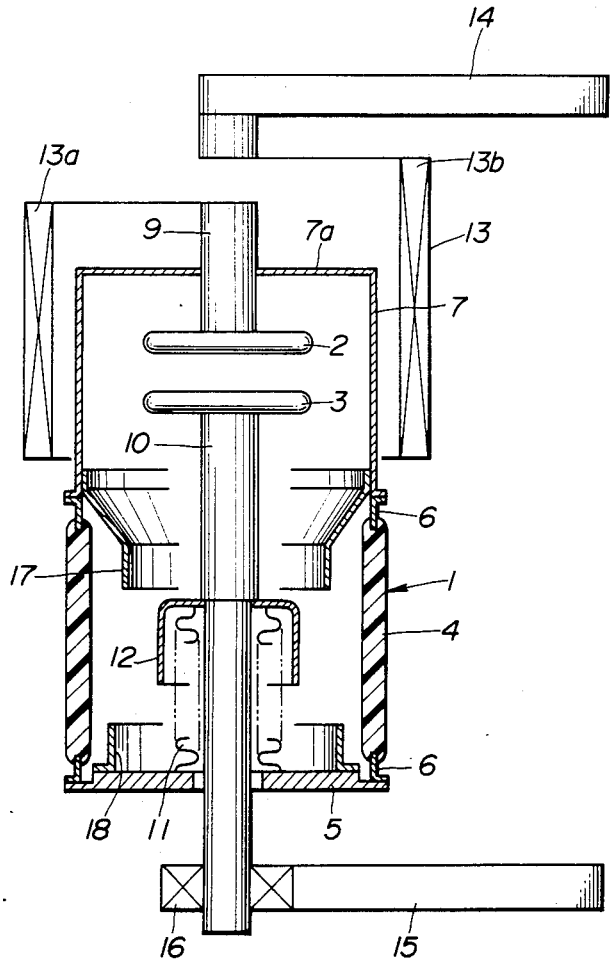
FIG. 1 (PRIOR ART)
FIG. 1 is a longitudinal section through a prior-art vacuum interrupter.

In addition, the stationary and movable electrodes 21 and 22 are separated from the slide contact 31 and arm 71 by a distance corresponding to the length of the bellows 29 which is greater than the distance separating the stationary and movable electrodes 2 and 3 from the outer lead rod 14 in the prior-art vacuum interrupter of FIG. 1, so that the magnetic field produced by the slide contact 31 and the arm 71 cannot adversely affect the axial magnetic field produced by a turning portion of the coil 30. This improves the interruption performance of the vacuum interrupter of this invention.

What is claimed is:

1. A vacuum interrupter, comprising:

a vacuum envelope including an insulating cylinder, a metal end plate hermetically sealed to one edge of the insulating cylinder and a bottomed metal cylinder having its open end hermetically sealed to the other edge of the insulating cylinder;

a pair of disc-shaped electrodes comprising a stationary electrode and a movable electrode disposed facing each other within the metal cylinder, said movable electrode being movable for establishing or interrupting contact with said stationary electrode;

a stationary lead rod passing hermetically through the metal end plate and the insulating cylinder and fixed to the metal end plate, the stationary lead rod having an inner end fixed to the stationary electrode;

a movable lead rod passing through the bottom of the metal cylinder and being movable coaxially with the stationary lead rod, the movable lead rod having an inner end fixed to the movable electrode and having an outer end located outside the vacuum envelope, the movable lead rod being shorter than the stationary lead rod;

a metal bellows surrounding part of the movable lead rod and hermetically and electrically connecting the movable lead rod to the bottom of the metal cylinder, the metal bellows being located outside the metal cylinder and having an exterior exposed to the air and an interior exposed to a vacuum of the vacuum envelope; and a substantially cylindrical coil located outside the metal cylinder and surrounding the stationary and movable electrodes, the coil having one end electrically connected to the movable lead rod via a slide contact engaging the surface of the movable lead rod and having the other end electrically connected to an outer lead means, the coil producing an axial magnetic field in parallel to an arc current path formed between the stationary and movable electrodes when the movable electrode is separated from the stationary electrode.

2. A vacuum interrupter as recited in claim 1, wherein a vacuum space behind the stationary electrode is larger than a vacuum space behind the movable electrode.

3. A vacuum interrupter as recited in claim 1, wherein the stationary lead rod has a small diameter stem portion including the inner end and has a large diameter stem portion extending from an intermediate portion of the insulating cylinder to the metal end plate, a presence of a shoulder formed between the small diameter stem portion and the large diameter stem portion preventing a concentration of electric field at a point of connection between the insulating cylinder and the metal end plate.

4. A vacuum interrupter as recited in claim 1, wherein each edge of the insulating cylinder has a metallized layer, the metal end plate is brazed to the metallized layer on the one edge of the insulating cylinder, the open end of the metal cylinder is brazed to the metallized layer on the other edge of the insulating cylinder, and wherein the metal cylinder has a main shield surrounding part of the stationary lead rod and extending into the interior of the insulating cylinder, the main shield having an outwardly curled edge in the insulating cylinder, and wherein the metallized layer on the other edge of the insulating cylinder is located within a tangential plane running across the surface of the curled edge of the main shield and an outer periphery of an edge surface of the coil located in a side of the insulating cylinder.

5. A vacuum interrupter as recited in claim 1, wherein the one end of the coil is connected to an arm electrically connected to the slide contact and extending perpendicularly to the movable lead rod and wherein the arm is spaced from the outer surface of the bottom of the metal cylinder by at least a distance corresponding to a length of the metal bellows, the distance preventing a magnetic field produced by a current passing the arm from disordering the axial magnetic field produced by the cylindrical portion of the coil.

6. A vacuum interrupter as recited in claim 1, wherein the vacuum interrupter is designed to be installed in an upright position in a circuit breaker so that the insulating cylinder is located above the metal cylinder.

7. A vacuum interrupter as recited in claim 1, wherein the vacuum interrupter is designed to be installed in an upright position in a circuit breaker so that the insulating cylinder is located below the metal cylinder.

* * * * *